US005389165A

United States Patent [19]

Cho

[11] Patent Number: 5,389,165

[45] Date of Patent: Feb. 14, 1995

[54] LOW DENSITY, HIGH STRENGTH AL-LI ALLOY HAVING HIGH TOUGHNESS AT ELEVATED TEMPERATURES

[75] Inventor: Alex Cho, Richmond, Va.

[73] Assignee: Reynolds Metals Company, Richmond, Va.

[21] Appl. No.: 883,831

[22] Filed: May 15, 1992

Related U.S. Application Data

[63] Continuation-in-part of Ser. No. 699,540, May 14, 1991, Pat. No. 5,198,045.

[51] Int. Cl.[6] ..... C22F 1/04

[52] U.S. Cl. ..... 148/552; 148/693; 148/697; 148/700; 148/417; 148/439; 420/529; 420/532; 420/533; 420/543

[58] Field of Search ..... 148/552, 417, 439, 693, 148/697, 700; 420/529, 532, 533, 543

[56] References Cited

U.S. PATENT DOCUMENTS

| | | | |
|---|---|---|---|
| 5,032,359 | 7/1991 | Pickens et al. | 420/533 |
| 5,198,045 | 3/1993 | Cho et al. | 148/552 |
| 5,211,910 | 5/1993 | Pickens et al. | 420/532 |

OTHER PUBLICATIONS

Suresh, S. and Vasudevan, A. K. "Influence of Composition and Aging Treatment on Fracture Toughness of Lithium-Containing Aluminum Alloys", Aluminum Lithium Alloys III, Conference Proceedings, pp. 595-601.

White, J. et al., "Effect of Precipitation on Mechanical Properties of Al-Li-Cu-Mg-Zr", Aluminum Lithium Alloys III, Conference Proceedings, pp. 530-538.

Rinker, Marek and Sanders, *Mat. Cir. and Eng.* 64, 1984, pp. 207-208.

*Primary Examiner*—Richard O. Dean
*Assistant Examiner*—Robert R. Koehler
*Attorney, Agent, or Firm*—Alan M. Biddison

[57] ABSTRACT

An aluminum-based alloy useful in aircraft and aerospace structures which has low density, high strength and high fracture toughness consists essentially of the following formula:

$$Cu_aLi_bMg_cAg_dZr_eAl_{bal}$$

wherein a, b, c, d, e and bal indicate the amount in wt. % of alloying components, and wherein $2.8<a<3.8$, $0.80<b<1.3$, $0.20<c<1.00$, $0.20<d<1.00$ and $0.08<e<0.40$. Preferably, the copper and lithium components are controlled such that the combined copper and lithium content are kept below the solubility limit to avoid loss of fracture toughness during elevated temperature exposure. The relationship between the copper and lithium contents also should meet the following relationship:

$$Cu\ (wt.\ \%)+1.5\ Li\ (wt.\ \%)<5.4.$$

15 Claims, 6 Drawing Sheets

LOW DENSITY, HIGH STRENGTH AL-LI ALLOY HAVING HIGH TOUGHNESS AT ELEVATED TEMPERATURES

This application is a continuation-in-part application of U.S. Ser. No. 07/699,540 filed on May 14, 1991, now U.S. Pat. No. 5,198,045.

FIELD OF THE INVENTION

This invention relates to an improved aluminum lithium alloy and more particularly relates to an aluminum lithium alloy which contains copper, magnesium and silver and is characterized as a low density alloy capable of maintaining an acceptable level of fracture toughness and high strength when subjected to elevated temperatures for long duration in aircraft and aerospace applications.

BACKGROUND OF THE INVENTION

In the aircraft industry, it has been generally recognized that one of the most effective ways to reduce the weight of an aircraft is to reduce the density of the aluminum alloys used in the aircraft construction. For purposes of reducing the alloy density, lithium additions have been made. However, the addition of lithium to aluminum alloys is not without problems. For example, the addition of lithium to aluminum alloys often results in a decrease in ductility and fracture toughness. Where the use is in aircraft parts, it is imperative that the lithium containing alloy have improved ductility, fracture toughness, and strength properties.

With respect to conventional alloys, both high strength and high fracture toughness appear to be quite difficult to obtain when viewed in light of conventional alloys such as AA (Aluminum Association) 2024-T3X and 7050-T7X normally used in aircraft applications. For example, it was found for AA2024 sheet that toughness decreases as strength increases. Also, it was found that the same is true of AA7050 plate. More desirable alloys would permit increased strength with only minimal or no decrease in toughness or would permit processing steps wherein the toughness was controlled as the strength was increased in order to provide a more desirable combination of strength and toughness. Additionally, in more desirable alloys, the combination of strength and toughness would be attainable in an aluminum-lithium alloy having density reductions in the order of 5 to 15%. Such alloys would find widespread use in the aerospace industry where low weight and high strength and toughness translate to high fuel savings. Thus, it will be appreciated that obtaining qualities such as high strength at little or no sacrifice in toughness, or where toughness can be controlled as the strength is increased provides a remarkably unique aluminum lithium alloy product.

It is known that the addition of lithium to aluminum alloys reduces their density and increases their elastic moduli producing significant improvements in specific stiffnesses. Furthermore, the rapid increase in solid solubility of lithium in aluminum over the temperature range of 0° to 500° C. results in an alloy system which is amenable to precipitation hardening to achieve strength levels comparable with some of the existing commercially produced aluminum alloys. However, the demonstratable advantages of lithium containing aluminum alloys have been offset by other disadvantages such as limited fracture toughness and ductility, delamination problems and poor stress corrosion cracking resistance.

Thus, only four lithium containing alloys have achieved usage in the aerospace field. These are two American alloys, AAX2020 and AA2090, a British alloy AA8090 and a Russian alloy AA01420.

An American alloy, AAX2020, having a nominal composition of Al-4.5Cu-1.1Li-0.5Mn-0.2Cd (all figures relating to a composition now and hereinafter in wt. %) was registered in 1957. The reduction in density associated with the 1.1% lithium addition to AAX2020 was 3% and although the alloy developed very high strengths, it also possessed very low levels of fracture toughness, making its efficient use at high stresses inadvisable. Further ductility related problems were also discovered during forming operations. Eventually, this alloy was formally withdrawn.

Another American alloy, AA2090, having a composition of Al-2.4 to 3.0 Cu-1.9 to 2.6 Li - 0.08 to 0.15 Zr, was registered with the Aluminum Association in 1984. Although this alloy developed high strengths, it also possessed poor fracture toughness and poor short transverse ductility associated with delamination problems and has not had wide range commercial implementation. This alloy was designed to replace AA7075-T6 with weight savings and higher modulus. However, commercial implementation has been limited.

A British alloy, AA8090, having a composition of Al-1.0 to 1.6 Cu - 0.6 to 1.3 Mg - 2.2 to 2.7 Li - 0.04 to 0.16 Zr, was registered with the Aluminum Association in 1988. The reduction in density associated with 2.2 to 2.7 wt. Li was significant. However, its limited strength capability with poor fracture toughness and poor stress corrosion cracking resistance prevented AA8090 from becoming a widely accepted alloy for aerospace and aircraft applications.

A Russian alloy, AA01420, containing Al-4 to 7 Mg - 1.5 to 2.6 Li - 0.2 to 1.0 Mn - 0.05 to 0.3 Zr (either or both of Mn and Zr being present), was described in U.K. Pat. No. 1,172,736 by Fridlyander et al. The Russian alloy AA01420 possesses specific moduli better than those of conventional alloys, but its specific strength levels are only comparable with the commonly used 2000 series aluminum alloys so that weight savings can only be achieved in stiffness critical applications.

Alloy AAX2094 and alloy AAX2095 were registered with the Aluminum Association in 1990. Both of these aluminum alloys contain lithium. Alloy AAX2094 is an aluminum alloy containing 4.4–5.2 Cu, 0.01 max Mn, 0.25–0.6 Mg, 0.25 max Zn, 0.04–0.18 Zr, 0.25–0.6 Ag, and 0.8–1.5 Li. This alloy also contains 0.12 max Si, 0.15 max Fe, 0.10 max Ti, and minor amounts of other impurities. Alloy AAX2095 contains 3.9–4.6 Cu, 0.10 max Mn, 0.25–0.6 Mg, 0.25 max Zn, 0.04–0.18 Zr, 0.25–0.6 Ag, and 1.0–1.6 Li. This alloy also contains 0.12 max Si, 0.15 max Fe, 0.10 max Ti, and minor amounts of other impurities.

It is also known from PCT application W089/01531, published Feb. 23, 1989, of Pickens et al., that certain aluminum-copper-lithium-magnesium-silver alloys possess high strength, high ductility, low density, good weldability, and good natural aging response. These alloys are indicated in the broadest disclosure as consisting essentially of 2.0 to 9.8 weight percent of an alloying element which may be copper, magnesium, or mixtures thereof, the magnesium being at least 0.01 weight percent, with about 0.01 to 2.0 weight percent silver, 0.05 to 4.1 weight percent lithium, less than 1.0 weight percent of a grain refining additive which may be zirconium, chromium, manganese, titanium, boron, hafnium, vanadium, titanium diboride, or mixtures thereof. A review of the specific alloys disclosed in this PCT application, however, identifies three alloys, specifically alloy 049, alloy 050, and alloy 051. Alloy 049 is an aluminum alloy containing in weight percent 6.2 Cu, 0.37 Mg, 0.39 Ag, 1.21 Li, and 0.17 Zr. Alloy 050 does not contain any copper; rather alloy 050 contains large amounts of magnesium, in the 5.0 percent range. Alloy 051 contains in weight percent 6.51 copper and very low amounts of magnesium, in the 0.40 range. This application also discloses other alloys identified as alloys 058, 059, 060, 061, 062, 063, 064, 065, 066, and 067. In all of these alloys, the copper content is either very high, i.e., above 5.4, or very low, i.e., less than 0.3. PCT Application No. WO90/02211, published Mar. 8, 1990, discloses similar alloys except that they contain greater than 5% Cu and no Ag.

It is also known that the inclusion of magnesium with lithium in an aluminum alloy may impart high strength and low density to the alloy, but these elements are not of themselves sufficient to produce high strength without other secondary elements. Secondary elements such as copper and zinc provide improved precipitation hardening response; zirconium provides grain size control, and elements such as silicon and transition metal elements provide thermal stability at intermediate temperatures up to 200° C. However, combining these elements in aluminum alloys has been difficult because of the reactive nature in liquid aluminum which encourages the formation of coarse, complex intermetallic phases during conventional casting.

Recent and renewed interest in supersonic transport airplane developmental programs has generated a need for thermally stable, low density, high strength structural aluminum alloys having acceptable levels of fracture toughness. It has been determined that commercially available Al-Cu-Li alloy AA2090 is not suitable for supersonic application. R.J. Bucci et al., in Naval Surface Warfare Center TR 89-106 Report, note that fracture toughness of AA2090 degraded severely after a moderate thermal exposure at 212° F. for about 1,000 hours. In order to achieve the property characteristics suitable for supersonic aircraft structural applications, it is necessary to develop an alloy with good thermal stability at elevated temperatures in the range of 200° F. to 350° F. Moreover, alloys must be developed which also have sufficient physical and mechanical properties for subsonic aircraft structural applications.

In the prior art, Al-Cu based high strength alloys such as AA2219 and AA2519 have been used in elevated temperature aircraft applications. These Al-Cu alloys, however, have only a moderately high strength with a rather high density (0.103 lbs/in$^3$).

As stated above, the prior art has proposed Al-Cu-Li-Mg-Ag alloy systems for achieving high strength and high stress corrosion cracking resistance among the Al-Li type aluminum-based alloys.

However, the prior art alloy systems discussed above, i.e., Al-Cu based and Al-Cu-Li-Mg-Ag based, exhibit different characteristics in overaging behavior and exposure to elevated temperatures over extended periods of time.

With reference to FIG. 1, differences in age hardening and softening behavior are illustrated between non-lithium containing aluminum-based alloys and lithium containing aluminum-based alloys. The two types of alloys illustrated in FIG. 1 are subjected to increased amounts of thermal exposure, i.e., overaging after artificial aging to peak strengths. During overaging, conventional 7000 series alloys (Al-Zn-Mg-Cu) are represented by the dotted line. These alloys reach peaks strength condition during overaging and, thereafter, additional aging or repeated exposure to elevated temperatures causes these alloys to become softer while at the same time allowing the alloys to recover their fracture toughness. This is indicated by the U-shaped portion of the AA7000 series alloy which curves around and continues upwardly after reaching a given peak strength.

Prior art Al-Li high strength aluminum based alloys are represented in FIG. 1 by the solid line. Once the Al-Li alloy reaches its peak strength by artificial aging, additional exposure to an elevated temperature environment permits the alloy to recover its fracture toughness and ductility only after a severe loss of strength. This is indicated by the broadly shaped curve which, when eventually extending upwardly as the curve for the non-lithium aluminum alloys does, indicates a low strength when fracture toughness recovers.

As such, a need has developed to provide a high strength Al-Li alloy for elevated temperature applications which maintains an acceptable level of fracture toughness throughout thermal exposure to an elevated temperature environment during aircraft or aerospace applications.

Therefore, considerable effort has been directed to producing low density aluminum based alloys capable of being formed into structural components for use in elevated temperature application in the aircraft and aerospace industries. The alloys provided by the present invention are believed to meet this need of the art.

The present invention provides an aluminum lithium alloy with specific characteristics which are improved over prior known alloys. The alloys of this invention, which have the precise amounts of the alloying components described herein, in combination with the atomic ratio of the lithium and copper components and density, provide a select group of alloys which has outstanding and improved characteristics for use in the aircraft and aerospace industry.

SUMMARY OF THE INVENTION

It is accordingly one object of the present invention to provide a low density, high strength aluminum based alloy which contains lithium, copper, and magnesium.

A further object of the invention is to provide a low density, high strength, high fracture toughness aluminum based alloy which contains critical amounts of lithium, magnesium, silver and copper.

Another object of the present invention is to provide an aluminum based alloy containing critical amounts of alloying elements, in particular, lithium and copper, which, when subjected to extended elevated temperatures, maintains an acceptable level of fracture toughness with high strength.

A still further object of the invention is to provide a method for production of such alloys and their use in aircraft and aerospace components.

Other objects and advantages of the present invention will become apparent as the description thereof proceeds.

In satisfaction of the foregoing objects and advantages, there is provided by the present invention an aluminum based alloy consisting essentially of the following formula:

$$Cu_aLi_bMg_cAg_dZr_eAl_{bal}$$

wherein a, b, c, d, e, and bal indicate the amounts in weight percent of each alloying component present in the alloy, and wherein the letters a, b, c, d and e have the indicated values:

$2.8<a<3.8$
$0.80<b<1.3$
$0.20<c<1.00$
$0.20<d<1.00$
$0.08<e<0.40$ with up to 0.25 wt. % of each of impurities such as Si, Fe, and Zn and up to a maximum total of 0.5 wt. %. Preferably, no one impurity, other than Si, Fe, and Zn, is present in an amount greater than 0.05 weight %, with the total of such other impurities being preferably less than 0.15 weight %. The alloys are also characterized by a relationship between Cu and Li defined as:

$$Cu\ (wt\ \%)+1.5Li\ (wt\ \%)<5.4$$

Suitable grain refining elements such as titanium, manganese, hafnium, scandium, and chromium may be included in the inventive alloy composition.

In a preferred embodiment, the alloy composition consists essentially of 3.6Cu-1.1Li-0.4Mg-0.4Ag-0.14Zr with impurities and grain refining elements as described above and having a density of about 0.971 lbs/in$^3$.

The present invention also provides a method for preparation of products using the alloy of the invention which comprises a) casting billets or ingots of the alloy;
b) relieving stress in the billet or ingots by heating at temperatures of approximately 600° to 800° F.;
c) homogenizing the grain structure by heating the billet or ingot and cooling;
d) hot working to produce a wrought product;
e) solution heat treating the wrought product;
f) stretching the solution heat treated product; and
g) aging the stretched product.

Also provided by the present invention are aircraft and aerospace structural components which contain the alloys of the invention and are made according to the inventive method.

BRIEF DESCRIPTION OF THE DRAWINGS

Reference is now made to the drawings illustrating the invention wherein.

DESCRIPTION OF PREFERRED EMBODIMENTS

Figure 1:
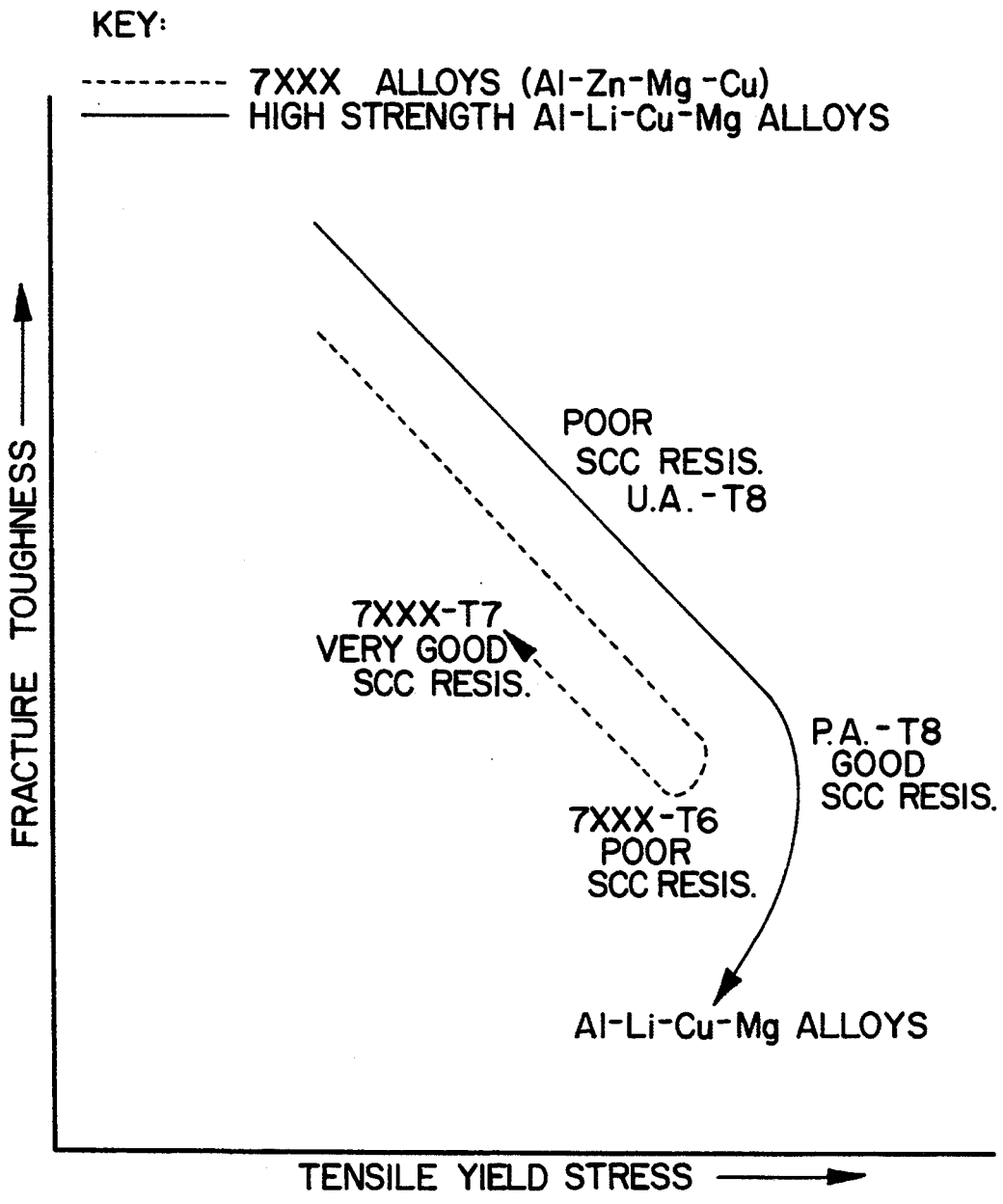
FIG. 1 is a graph comparing fracture toughness and tensile yield stress for lithium containing and non-lithium containing prior art aluminum alloys subjected to aging treatment.

The objective of the present invention is to provide an aluminum-based alloy and a method of making a product containing the alloy which provides acceptable levels of fracture toughness and strength when subjected to elevated temperature use.

U.S. patent application Ser. No. 07/699,540, now U.S. Pat. No. 5,198,045 to Alex Cho discloses an alloy composition having, by weight percent, 3.6 Cu-1.1 Li-0.4Mg-0.4Ag-0.14Zr (0.5% below the solubility limit) which is able to maintain fracture toughness values ($K_1c$) above 20 ksi-$\sqrt{}$inch for long term exposures, such as 100 and 1,000 hours at various elevated temperatures, such as 300° F., 325° F. and 350° F. The entire contents of Ser. No. 07/699,540 is herein incorporated by reference.

The present invention further defines an Al-Li alloy compositional range, a method of making and product made by the method which combine fracture toughness and high strength throughout exposure to elevated temperatures. In an improvement over other prior art alloys, the inventive alloy composition avoids the problem of decreases in fracture toughness over periods of time during elevated temperature exposure. Prior art alloys that exhibit a decrease in fracture toughness, even for a short period of time, are unacceptable for use in long term elevated temperature use. Even if these alloys were capable of recovering fracture toughness lost after further elevated temperature exposure, a decrease to unacceptable levels of fracture toughness can result in premature failure. The potential of a premature failure eliminates any potential use of these types of prior art alloys even though they may exhibit fracture toughness increases after long term exposure at elevated temperatures.

The advantages of the inventive alloy composition and method of making an aluminum alloy product are further demonstrated when referring again to FIG. 1. With reference to the solid line in FIG. 1, even if fracture toughness were to recover after extensive elevated temperature exposure, structural components employing the prior art alloys would fall below minimum levels of fracture toughness and strength. The inventive alloy composition maintains an acceptable level of fracture toughness throughout elevated temperature exposure.

The inventive alloy composition includes the primary alloying elements of copper, lithium, magnesium, silver and zirconium. The alloy composition may also include one or more grain refining elements as essential components. The suitable grain refining elements include one or more of a combination of the following: zirconium, titanium, manganese, hafnium, scandium and chromium.

The inventive alloy composition may also contain incidental impurities such as silicon, iron and zinc.

The aluminum based low density alloy of the invention consists essentially of the formula:

$$Cu_aLi_bMg_cAg_dZr_eAl_{bal}$$

wherein a, b, c, d and e indicate the amount of each alloy component in weight percent and bal indicates the remainder to be aluminum which may include impurities and/or other components, such as grain refining elements.

A preferred embodiment of the invention is an alloy wherein the letters a, b, c, d and e have the indicated values:

$2.8<a<3.8$
$0.80<b<1.3$
$0.20<c<1.00$
$0.20<d<1.00$
$0.08<e<0.40$

In defining the particular ranges for each alloying component, the copper content should be kept higher than 2.8 weight percent to achieve high strength, but less than 3.8 weight percent to maintain good fracture toughness during overaging.

Lithium content should be kept higher than 0.8 weight percent to achieve good strength and low density, but less than 1.3 wt % to avoid loss of fracture toughness during overaging.

In another aspect of the invention, the relationship between overall solute contents of copper and lithium should be controlled to avoid loss of fracture toughness during exposure to elevated temperatures. To avoid severe loss of fracture toughness, the combined copper and lithium content should be kept below solubility limit by at least 0.4 wt. % of copper for a given lithium content. The relationship between copper and lithium is stated as:

$$Cu(wt\ \%)+1.5Li(wt\ \%)<5.4$$

The levels of magnesium and silver content should range between about 0.2 wt. % to about 1.0 wt. %, respectively. The grain refining elements, if included in the alloy composition range as follows: titanium up to 0.2 wt. %, magnesium up to 0.5 wt. %, Hafnium up to 0.2 wt. %, scandium up to 0.5 wt. % and chromium up to 0.3 wt. %.

While providing the alloy product with controlled amounts of alloying elements as described hereinabove, it is preferred that the alloy be prepared according to specific method steps in order to provide the most desirable characteristics of both strength and fracture toughness. Thus, the alloy as described herein can be provided as an ingot or billet for fabrication into a suitable wrought product by casting techniques currently employed in the art for cast products. It should be noted that the alloy may also be provided in billet form consolidated from fine particulate such as powdered aluminum alloy having the compositions in the ranges set forth hereinabove. The powder or particulate material can be produced by processes such as atomization, mechanical alloying and melt spinning. The ingot or billet may be preliminarily worked or shaped to provide suitable stock for subsequent working operations. Prior to the principal working operation, the alloy stock is preferably stress relieved and subjected to homogenization to homogenize the internal structure of the metal. Stress relief may be done for about 8 hours at temperatures between 600° and 800° F. Homogenization temperature may range from 650°–1000° F. A preferred time period is about 8 hours or more in the homogenization temperature range. Normally, the heat up and homogenizing treatment does not have to extend for more than 40 hours; however, longer times are not normally detrimental. A time of 20 to 40 hours at the homogenization temperature has been found quite suitable. For example, the ingot may be soaked at about 940° F. for 8 hours followed by soaking at 1000° F. for about 36 hours and cooling. In addition to dissolving constituents to promote workability, this homogenization treatment is important in that it is believed to precipitate dispersoids which help to control final grain structure.

After the homogenizing treatment, the metal can be rolled or extruded or otherwise subjected to working operations to produce stock such as sheet, plate or extrusions or other stock suitable for shaping into the end product.

That is, after the ingot or billet has been homogenized, it may be hot worked or hot rolled. Hot rolling may be performed at a temperature in the range of 500° to 950° F. with a typical temperature being in the range of 600° to 900° F. Hot rolling can reduce the thickness of an ingot to one-fourth of its original thickness or to final gauge, depending on the capability of the rolling equipment. In a preferred rolling sequence, the ingot or billet is preheated and soaked for 3 to 5 hours at 950° F., air cooled to 900° F. and hot rolled. Cold rolling may be used to provide further gauge reduction.

The rolled material is preferably solution heat treated typically at a temperature in the range of 960° to 1040° F. for a period in the range of 0.25 to 5 hours. To further provide for the desired strength and fracture toughness necessary to the final product and to the operations in forming that product, the product should be rapidly quenched or fan cooled to prevent or minimize uncontrolled precipitation of strengthening phases. Thus, it is preferred in the practice of the present invention that the quenching rate be at least 100° F. per second from solution temperature to a temperature of about 200° F. or lower. A preferred quenching rate is at least 200° F. per second from the temperature of 940° F. or more to the temperature of about 200° F. After the metal has reached a temperature of about 200° F., it may then be air cooled. In a preferred solution heat treatment, the worked product is solution heat treated at about 1000° F. for about one hour followed by cold water quenching. When the alloy of the invention is slab cast or roll cast, for example, it may be possible to omit some or all of the steps referred to hereinabove, and such is contemplated within the purview of the invention.

After solution heat treatment and quenching as noted, the improved sheet, plate or extrusion or other wrought products are artificially aged to improve strength, in which case fracture toughness can drop considerably. To minimize the loss in fracture toughness associated with improvement in strength, the solution heat treated and quenched alloy product, particularly sheet, plate or extrusion, prior to artificial aging, may be stretched, preferably at room temperature. For example, the solution treated rolled material is stretched to 6% within 2 hours.

After the alloy product of the present invention has been worked, it may be artificially aged to provide the combination of fracture toughness and strength which are so highly desired in aircraft members. This can be accomplished by subjecting the sheet or plate or shaped product to a temperature in the range of 150° to 400° F. for a sufficient period of time to further increase the yield strength. Preferably, artificial aging is accomplished by subjecting the alloy product to a temperature in the range of 275° to 375° F. for a period of at least 30 minutes. A suitable aging practice contemplates a treatment of about 8 to 32 hours at a temperature of between about 320° F. and 340° F. and, in particular, 12, 16 and/or 32 hours at either 320° F. or 340° F. Further, it will be noted that the alloy product in accordance with the present invention may be subjected to any of the typical underaging treatments well known in the art, including natural aging. Also, while reference has been made to single aging steps, multiple aging steps, such as two or three aging steps, are contemplated to improve properties, such as to increase the strength and/or to reduce the severity of strength anisotrophy.

In an effort to further demonstrate the advantages of the present invention, the following examples are presented to illustrate the invention, but the invention is not to be considered as limited thereto.

For comparison purposes, chemical compositions of six experimental alloys and two base line alloys are listed in Table I. The two base line alloys represent known aluminum alloys X2095 and X2094. The six experimental alloy compositions were selected to evaluate the effects of copper and lithium contents and their atomic ratio, as well as total solute contents on thermal stability, strength and fracture toughness. It should be noted that the chemistry analysis for the compositions listed in Table I were conducted using inductive plasma techniques from 0.75 inch gauge plate. Moreover, the percentages of the alloying elements are in weight percent.

TABLE I

| Alloy | Density (#/in3) | Li:Cu (atomic) | Cu (%) | Li (%) | Mg (%) | Ag (%) | Zr (%) |
|---|---|---|---|---|---|---|---|
| A | .0948 | 5.63 | 2.75 | 1.69 | .34 | .39 | .13 |
| B | .0950 | 5.76 | 2.51 | 1.58 | .37 | .37 | .15 |
| C | .0958 | 4.29 | 3.01 | 1.41 | .42 | .40 | .14 |
| D | .0963 | 3.58 | 3.48 | 1.36 | .36 | .40 | .13 |
| E | .0966 | 3.20 | 3.84 | 1.33 | .37 | .42 | .12 |
| F* | .0971 | 2.79 | 3.61 | 1.10 | .33 | .40 | .14 |
| AAX2095 | .0971 | 2.69 | 4.12 | 1.21 | .36 | .38 | .14 |
| AAX2094 | .0974 | 2.40 | 4.77 | 1.25 | .39 | .37 | .14 |

*Preferred inventive alloy composition.

In selecting the chemical compositions listed in Table I, a target density range of 0.095 and 0.098 lbs/in$^3$ was established. As can be seen from Table I, each of the six experimental alloys A–F and the two prior art alloys fell within the target density range. The alloying elements of magnesium, silver and zirconium were essentially fixed at 0.4 wt. %, 0.4 wt. % and 0.14 wt. %, respectively. The amounts of copper and lithium and the atomic ratio of lithium to copper were varied for the six experimental alloys A–F.

Figure 2:
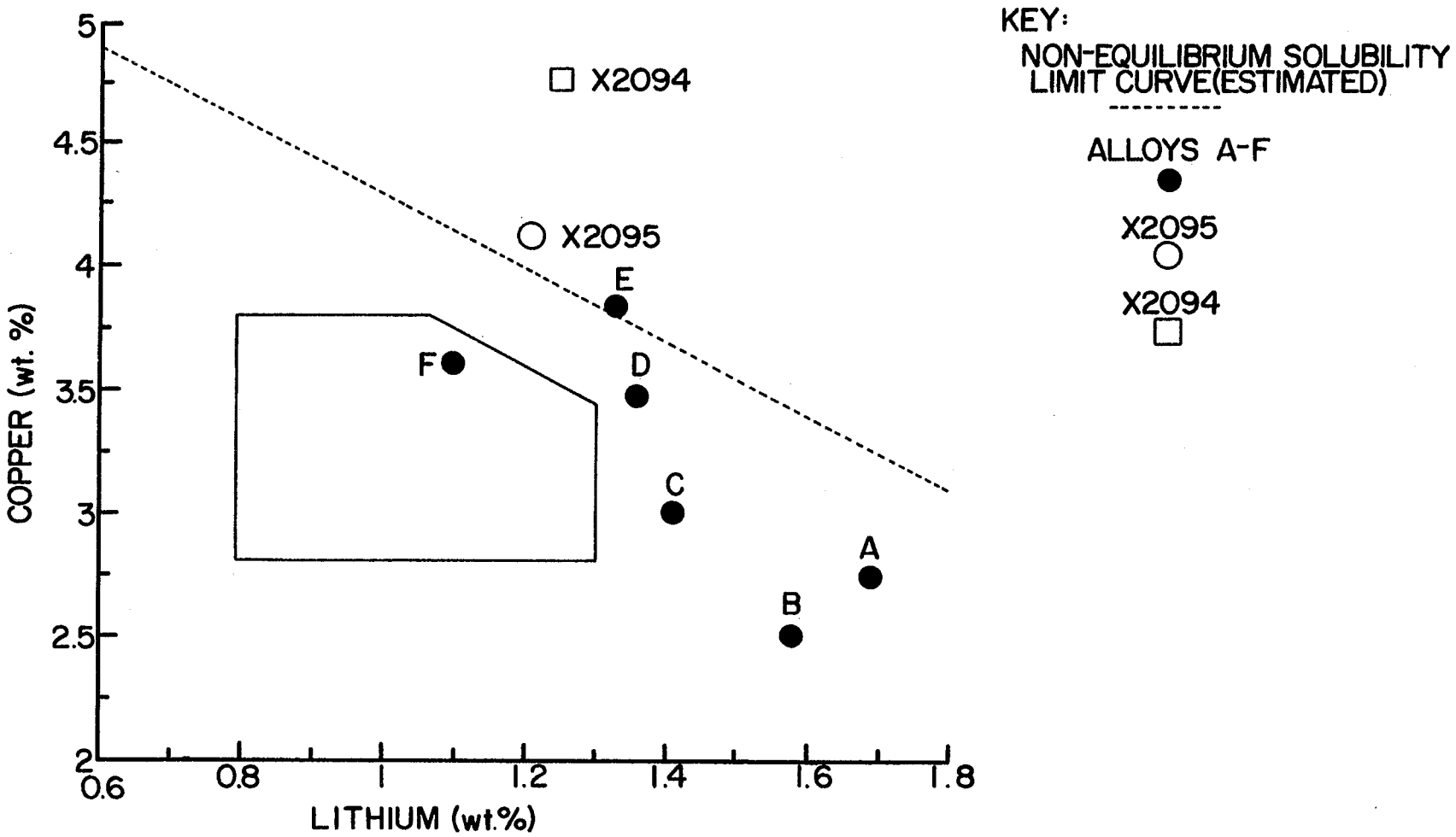
FIG. 2 shows the relationship between weight percent copper and lithium for alloy compositions according to the present invention and prior art compositions.

The copper and lithium contents of the six experimental alloys and the two prior art alloys are plotted in FIG. 2 against an estimated solubility limit curve at the nonequilibrium melting temperatures, the solubility curve shown as a dashed line. As can be seen from FIG. 2, the copper content of all alloys disclosed ranges from about 2.5 to 4.7 wt. % with the amount of lithium ranging from 1.1 to 1.7 wt. %. As set forth above, the total solute content relative to the solubility limit is an important variable in the combination of strength and fracture toughness for the inventive alloy. As shown in FIG. 2, all six experimental alloy compositions were chosen to be below the estimated solubility limit curve to ensure good fracture toughness. Four of the alloys, i.e. A, B, C and F, are relatively low solute alloys with alloys D and E being medium solute content alloys. Alloys D and E approach the solubility limit curve. In contrast, the prior art alloys, AAX2094 and AAX2095, are well above the solubility limit curve.

FIG. 2 also illustrates a compositional box representing the preferred ranges of copper and lithium for the inventive alloy. The compositional box is represented by five points which interconnect to encompass a preferred range of copper and lithium for the inventive alloy. The compositional box is defined by the five points, 3.8 Cu-0.8 Li, 2.8 Cu-0.8 Li, 2.8 Cu-1.3 Li, 3.45 Cu-1.3 Li and 3.8 Cu-1.07 Li, all figures representing weight percent.

The upper and lower limits for copper and lithium which define the horizontal and vertical lines of the compositional box are described above. The oblique portion of the compositional box represents maintaining the combined copper and lithium content to below a solubility limit of 0.5 wt. % of copper for a given lithium content.

The six alloys A–F were direct chill casted into 9 inch diameter round billets. The round billets were stress relieved for about 8 hours in temperatures from 600° F. –800° F. Alloy billets A–F were then sawed and homogenized using a conventional practice including the following steps:

1) Heated to 940° F. at 50° F./hr;
2) Soaked for 8 hours at 940° F.;
3) Heated up to 1000° F. at 50° F./hour or slower;
4) Soaked for 36 hours at 1000° F.;
5) Fan cooled to room temperature; and
6) The two sides of these billets were then machined by equal amounts to 6" thick rolling stocks for hot rolling to plate.

The comparison prior art alloys were derived from plant produced plate samples for comparison purposes. The prior art alloys, AAX2095 and AAX2094, were direct chill cast in 12" thick by 45" rectangular ingots. Following stress relieving for 8 hours at temperatures from 600° F. –800° F., the ingots were sawed and homogenized according to the following steps:

1) Heated to 930° F. at slower than 50° per hour;
2) Soaked for 36 hours at 930° F.;
3) Air cooled to room temperature; and
4) Both surfaces of the ingots were scalped by same amount and both sides were sawed to the final ingot cross-section of 10" by 40" for hot rolling.

Following homogenization, all alloys were subjected to hot rolling. Alloys A–F having two flat surfaces were hot rolled to plate and sheet. The hot rolling practice were as follows:

1) Preheated at 950° F. and soaked for 3 to 5 hours;
2) Air cooled to 900° before hot rolling;
3) Cross rolled to 4" thick slab;
4) Hot sheared bad edge cracks;
5) Straight rolled to 0.75" gauge plate; and
6) Air cooled to room temperature.

The prior art alloy ingots were hot rolled according to the following procedures:

1) Preheated to 910° F.–930° F. and soaked for 1 to 5 hours;
2) Cross rolled to 7" thick slab;
3) Straight rolled to 1.5" slab;
4) Reheated the slab to 900° F.–930° F.;
5) Hot rolled to 0.5" gauge slab; and
6) Air cooled to room temperature.

Following hot rolling, each of the alloys were solution heat treated. Alloys A–F comprising 0.75" gauge plate were sawed to 24" lengths and solution heat treated at 1000° F. for one hour and cold water quenched. All T3 and T8 temper plates were stretched to 6% within two hours.

Alloys AAX2095 and AAX2094, as 0.5" gauge plate, were solution heat treated at 940° F. for 2 hours, cold water quenched and stretched to 6%.

Following the solution heat treatment, all alloys were subjected to artificial aging. For alloys A–F, and in order to develop T8 temper properties, the T3 temper plate samples were aged at either 320° F. or 340° F. for 12, 16 and/or 32 hours. Alloy AAX2095-T3 temper plate samples were aged at 300° F. for 10 hours, 20 hours and 30 hours to develop T8 temper properties. Alloy AAX2094-T3 plate samples were aged at 300° F. for 12 hours.

To simulate the elevated temperature service environment of supersonic aircraft, 325° F. and 350° F. were chosen for evaluation. In this experiment, time periods of 100 hours and 1000 hours exposure were selected at 325° F. In addition, an exposure of 1000 hours at 350° F. was selected to further evaluate the compositional variations on the thermal stability of the eight alloys.

Following the above-described processing conditions, the mechanical properties were obtained for alloys A–F and alloys AAX2095 and AAX2094. Table II shows the results of age hardening to peak strengths in T8 temper conditions. It should be noted that all the tensile properties are the average values from duplicate tests. The fracture toughness test results are from single tests. Tensile tests were performed with longitudinal 0.350" round specimens with fracture toughness test being performed with W=1.5" compact tension specimens.

In order to make the property comparison more conservative between the AAX2094 and AAX2095 alloys and the alloys A–F, fracture toughness tests were conducted by CT specimens using a 0.75" thick test specimen for alloys A–F and a 0.5 "thick test specimen for the prior art alloys.

The results of the mechanical property testing are listed in Tables II–IV. Table II lists the results of tensile and fracture toughness tests, showing the artificial age response of alloys A–F and the two prior art alloys up to a peak strength in T8 temper conditions.

TABLE II

| Alloy | Age (hrs./°F.) | UTS (ksi) | TYS (ksi) | EL (%) | Kg (ksi-√inch) |
|---|---|---|---|---|---|
| A | 8/320 | 78.3 | 73.2 | 8.6 | N.A. |
| | 16/320 | 84.4 | 80.3 | 9.3 | 31.7/33.7 |
| | 24/320 | 84.8 | 81.0 | 8.2 | 30.6/28.6 |
| B | 8/320 | 74.0 | 68.2 | 8.6 | N.A. |
| | 16/320 | 77.2 | 73.6 | 10.0 | 36.7 |
| | 24/320 | 78.5 | 75.0 | 9.3 | 30.1 |
| C | 8/320 | 81.7 | 78.4 | 11.0 | 43.9 |
| | 16/320 | 82.6 | 79.1 | 11.0 | 37.7 |
| | 24/320 | 83.6 | 80.3 | 11.0 | 32.7 |
| D | 8/320 | 87.0 | 83.8 | 11.0 | 29.9 |
| | 16/320 | 88.7 | 85.5 | 11.0 | 24.9 |
| | 24/320 | 88.9 | 86.2 | 11.0 | 25.1 |
| E | 8/320 | 91.4 | 89.0 | 10.0 | 27.3 |
| | 16/320 | 95.5 | 92.9 | 9.0 | 22.8 |
| | 24/320 | 95.0 | 93.1 | 8.0 | 21.4 |
| F | 8/320 | 89.2 | 85.8 | 11.0 | 34.4 |
| | 16/320 | 88.3 | 85.0 | 10.0 | 28.8 |
| | 24/320 | 89.6 | 86.4 | 11.0 | 24.9 |
| AAX2095 | 10/300 | 88.7 | 84.0 | 9.3 | 27.7 |
| | 20/300 | 93.0 | 90.5 | 6.4 | 22.2 |
| | 30/300 | 94.0 | 91.5 | 7.1 | 18.4 |
| AAX2094 | 12/300 | 93.7 | 90.1 | 9.0 | 21.8 |

TABLE III

| Alloy | Exposure (hrs.) | UTS (ksi) | TYS (ksi) | EL (%) | Kg (ksi-√inch) |
|---|---|---|---|---|---|
| A | 100 | 76.5 | 72.0 | 7.0 | 22.2 |
| | 1,000 | 73.1 | 64.3 | 8.0 | 26.4 |
| B | 100 | 75.0 | 69.8 | 9.0 | 24.7 |
| | 1,000 | 70.1 | 61.4 | 11.0 | 29.4 |
| C | 100 | 80.4 | 76.0 | 11.0 | 24.8 |
| | 1,000 | 75.1 | 67.7 | 12.0 | 26.4 |
| D | 100 | 86.2 | 82.3 | 8.0 | 14.8 |
| | 1,000 | 78.9 | 71.6 | 10.0 | 20.8 |
| E | 100 | 89.1 | 87.3 | 5.0 | 14.5 |
| | 1,000 | 76.6 | 75.4 | 4.0 | 18.7 |
| F | 100 | 87.1 | 83.1 | 10.0 | 23.0 |
| | 1,000 | 80.4 | 73.6 | 10.0 | 22.0 |
| AAX2095 | 100 | 91.7 | 88.7 | 7.0 | 12.3 |
| | 1,000 | 81.5 | 74.2 | 9.0 | 12.4 |
| AAX2094 | 100 | 94.4 | 90.5 | 5.0 | 11.2 |
| | 1,000 | 83.9 | 76.6 | 6.0 | 11.9 |

It should be noted that mechanical properties were tested at different aging time periods for the purpose of determining increases and decreases in yield strength with respect to aging conditions. As will be described hereinafter, monitoring mechanical properties during aging facilitates evaluation of the various compositions for thermal stability.

Table III listed tensile yield stress (TYS) and fracture toughness (Kq) properties after long-term thermal exposure for 100 hours and 1000 hours, respectively, at 325° F. The additional exposure at these temperatures and time periods was applied to the alloys after the peak strengths as depicted in Table II were achieved.

Figure 3:
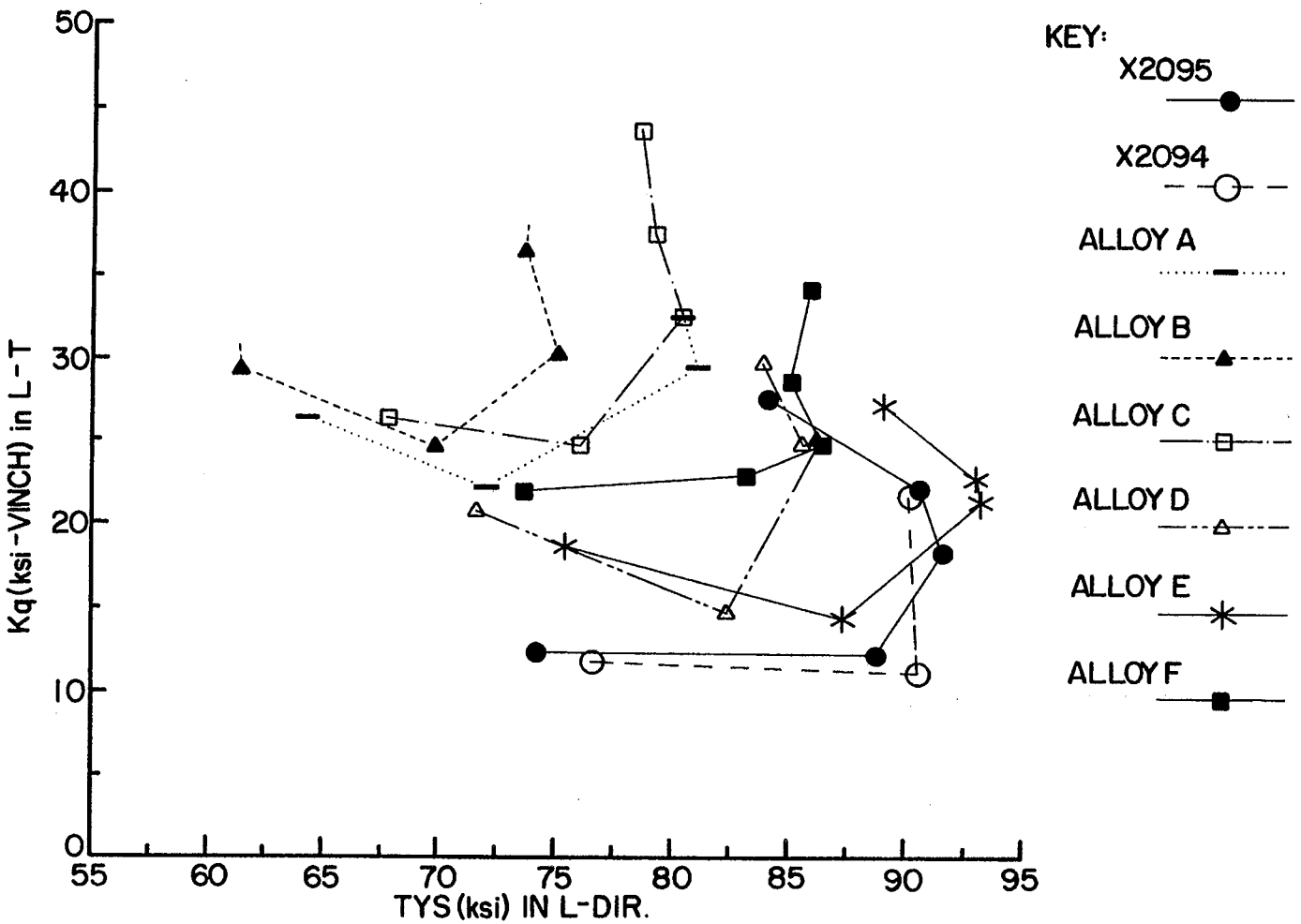
FIG. 3 is a graph comparing fracture toughness and yield strength for the alloys depicted in the key when aged to peak strength and exposed at 325° F. for 100 and 1,000 hours.

FIG. 3 plots the fracture toughness and tensile yield stress for the aging conditions specified in Table II and III. In this figure, an aging behavior curve is depicted for each alloy identified in the key. The aging behavior curve displays a data point corresponding to initial aging to peak, or near peak strength. Using this combined data enables a comparison of overaging behavior of alloys A–F and the two prior art tested alloys in a manner schematically illustrated in FIG. 1. For example, the aging curve for alloy F has three points of fracture toughness and corresponding tensile yield stress from Table II which are generally aligned vertically. Continuing on the same curve, two more data points are plotted which represent that 100 and 1000 hours exposure at 325° F. as shown in Table III. Thus, each alloy's curve shows extended overaging behavior as represented by the two additional points; the first additional point representing TYS-Kq values of the sample after 100 hours of overaging at 325° F., and the second additional point representing TYS-Kq values of the alloy after 1,000 hours of overaging at 325° F.

The base line alloys, AAX2095 and AAX2094, display the typical overaging behavior of high strength lithium-containing aluminum alloys as shown in FIG. 1, exhibiting significant loss of fracture toughness during overaging with no appreciable recovery of fracture toughness even after long term thermal exposure and severe loss of strength. This is demonstrated by the generally horizontal configuration of the AAX2095 and AAX2094 curves after achieving maximum tensile yield stress. In conjunction with the poor showing of fracture toughness even after long term thermal exposure, alloys AAX2095 and AAX2094 are high solute alloys, having compositions above the solubility limit curve as shown in FIG. 2.

Still with reference to FIG. 3, alloys A–C and F show no significant loss of fracture toughness during overaging during thermal exposure to 325° F. With reference to FIG. 2, these four alloys are low in copper and lithium content, i.e., overall solute content, when compared to the solubility limit curve. Alloys D and E, medium solute content alloys, show mixed behavior, a loss of fracture toughness in the initial stage of overaging with a recovery in fracture toughness only after severe loss of strength.

As demonstrated in FIG. 3, loss of fracture toughness below 20 ksi-√inch during overaging and ability to recover fracture toughness above 20 ksi-√inch after softening by additional overaging is strongly related to the level of combined copper and lithium solute content. When the total solute contents are sufficiently lower than the solubility limit, i.e., 0.5 wt. % lower in copper content than the solubility limit at the given lithium level, the alloy maintains good fracture toughness values above 20 ksi-√inch throughout the elevated temperature exposure.

Figure 4:
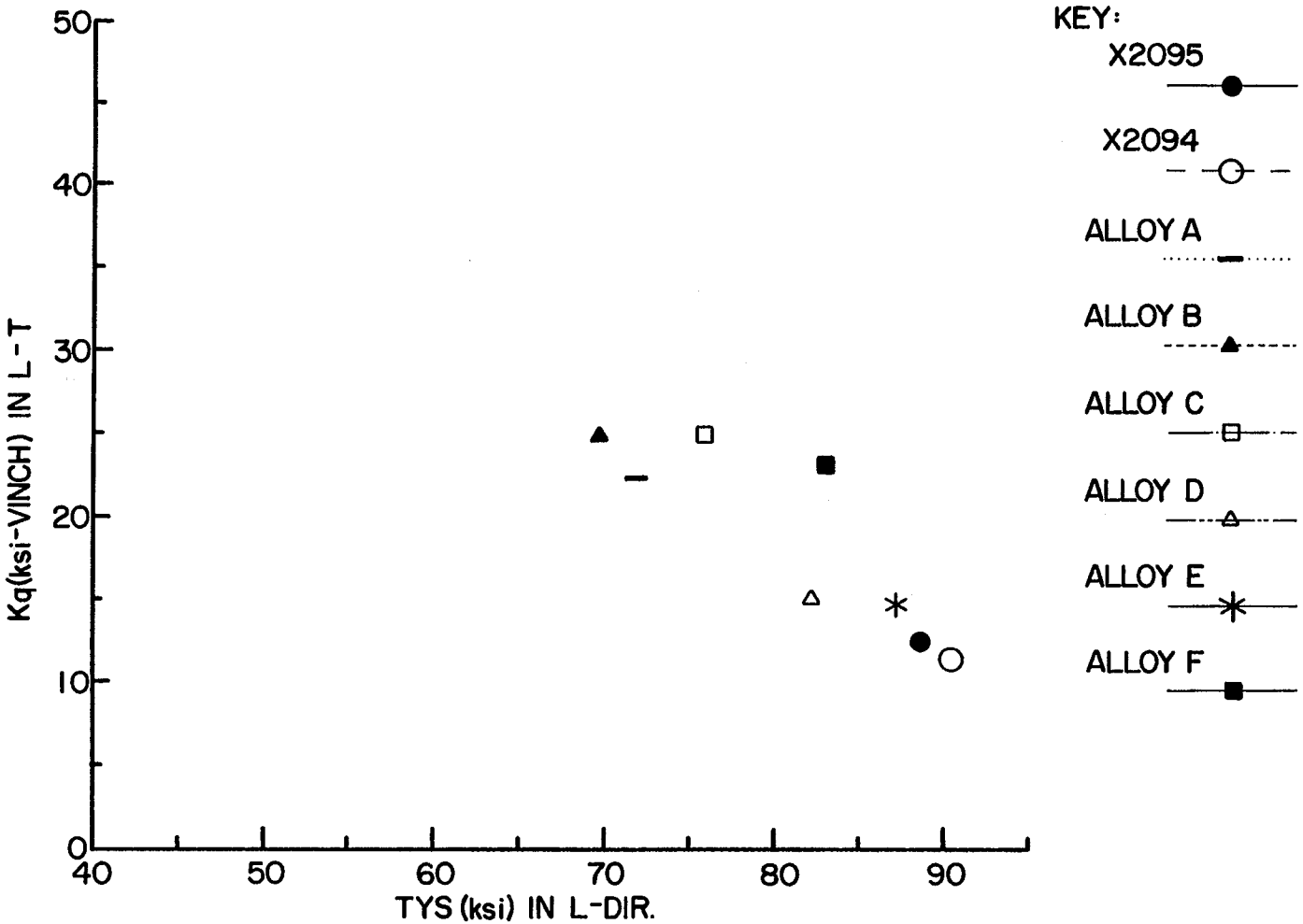
FIG. 4 is a graph relating fracture toughness and yield strength for the alloys depicted in the key after thermal exposure at 325° F. for about 100 hours.

To more clearly compare the superior fracture toughness of the inventive alloy composition, FIG. 4 plots fracture toughness and tensile yield stress for each alloy in the key after thermal exposure for 100 hours at 325° F. As can be seen from FIG. 4, alloys A–C and F retain good fracture toughness after 100 hours at 325° F., each alloy having greater than 20 ksi-√inch fracture toughness. Alloys F and C also retain higher strength than alloys A and B while maintaining similar fracture toughness of the two softer alloys, A and B. Alloy F shows higher strength than alloy C with alloy C showing slightly higher fracture toughness than alloy F. The data plotted in FIG. 4 corresponds to the second to last data point for each alloy curve in FIG. 3.

Figure 5:
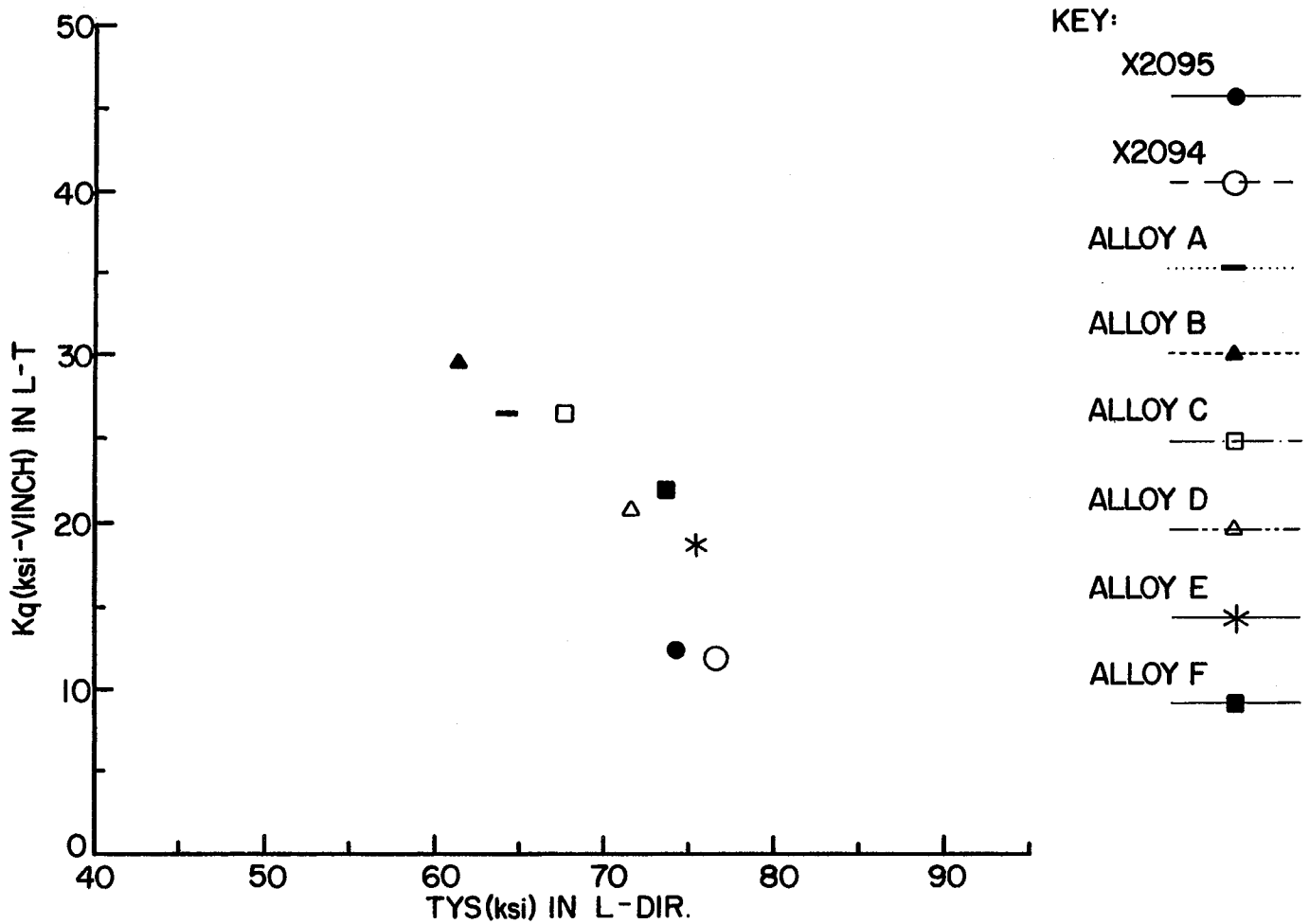
FIG. 5 shows another graph comparing fracture toughness and yield strength for the alloy compositions depicted in the key after exposure at 325° F. for about 1,000 hours.

FIG. 5 shows a graph similar to FIG. 4 showing the relationship between fracture toughness and tensile yield stress for each alloy in the key after 1000 hours at 325° F. thermal exposure. The data plotted in FIG. 5 corresponds to the final point on the curves depicted in FIG. 3.

The results depicted in FIG. 5 prove similar to those shown in FIG. 4. Again, alloys F and C retain good strengths and fracture toughness with alloy F retaining the highest strength and an acceptable level of fracture toughness, i.e. above 20 ksi-√inch. Alloy C shows higher fracture toughness again but lower strength than alloy F. It should be noted, however, that the two medium solute content alloys, D and E, showed some recovery of fracture toughness upon softening.

To further demonstrate effects of thermal exposure with the inventive alloy composition, Table IV lists tensile (TYS) and fracture toughness (Kq) properties of the alloys in Table I tested at room temperature after long-term thermal exposure at 350° F. This data is intended to simulate exposure at 325° F. for a period longer than 1000 hours since testing at 325° F. for an extended number of hours beyond 1000 hours was impractical during experimental procedures.

TABLE IV

| Alloy | Exposure (hrs.) | UTS (ksi) | TYS (ksi) | EL (%) | Kg (ksi-√inch) |
|---|---|---|---|---|---|
| A | 100 | 77.5 | 70.6 | 8.0 | 23.2 |
| | 1,000 | 64.2 | 50.5 | 9.0 | 26.5 |
| B | 100 | 72.2 | 65.3 | 11.0 | 29.3 |
| | 1,000 | 56.2 | 41.5 | 12.0 | 26.9 |
| C | 100 | 75.1 | 68.6 | 10.0 | 25.5 |
| | 1,000 | 60.1 | 45.3 | 10.0 | 29.7 |
| D | 100 | 81.4 | 75.6 | 9.0 | 18.9 |
| | 1,000 | 66.0 | 51.9 | 12.0 | 28.0 |

TABLE IV-continued

| Alloy | Exposure (hrs.) | UTS (ksi) | TYS (ksi) | EL (%) | Kg (ksi-√inch) |
|---|---|---|---|---|---|
| E | 100 | 85.7 | 81.1 | 4.0 | 16.3 |
| | 1,000 | 69.5 | 56.1 | 6.0 | 22.3 |
| F | 100 | 82.5 | 76.8 | 7.0 | 23.9 |
| | 1,000 | 69.0 | 56.8 | 9.0 | 25.6 |
| AAX2095 | 100 | 86.6 | 80.5 | 9.0 | 12.9 |
| | 1,000 | 70.0 | 57.7 | 9.0 | 17.9 |
| AAX2094 | 100 | 87.3 | 80.8 | 5.0 | 12.2 |
| | 1,000 | 71.3 | 57.4 | 7.0 | 15.6 |

Figure 6:
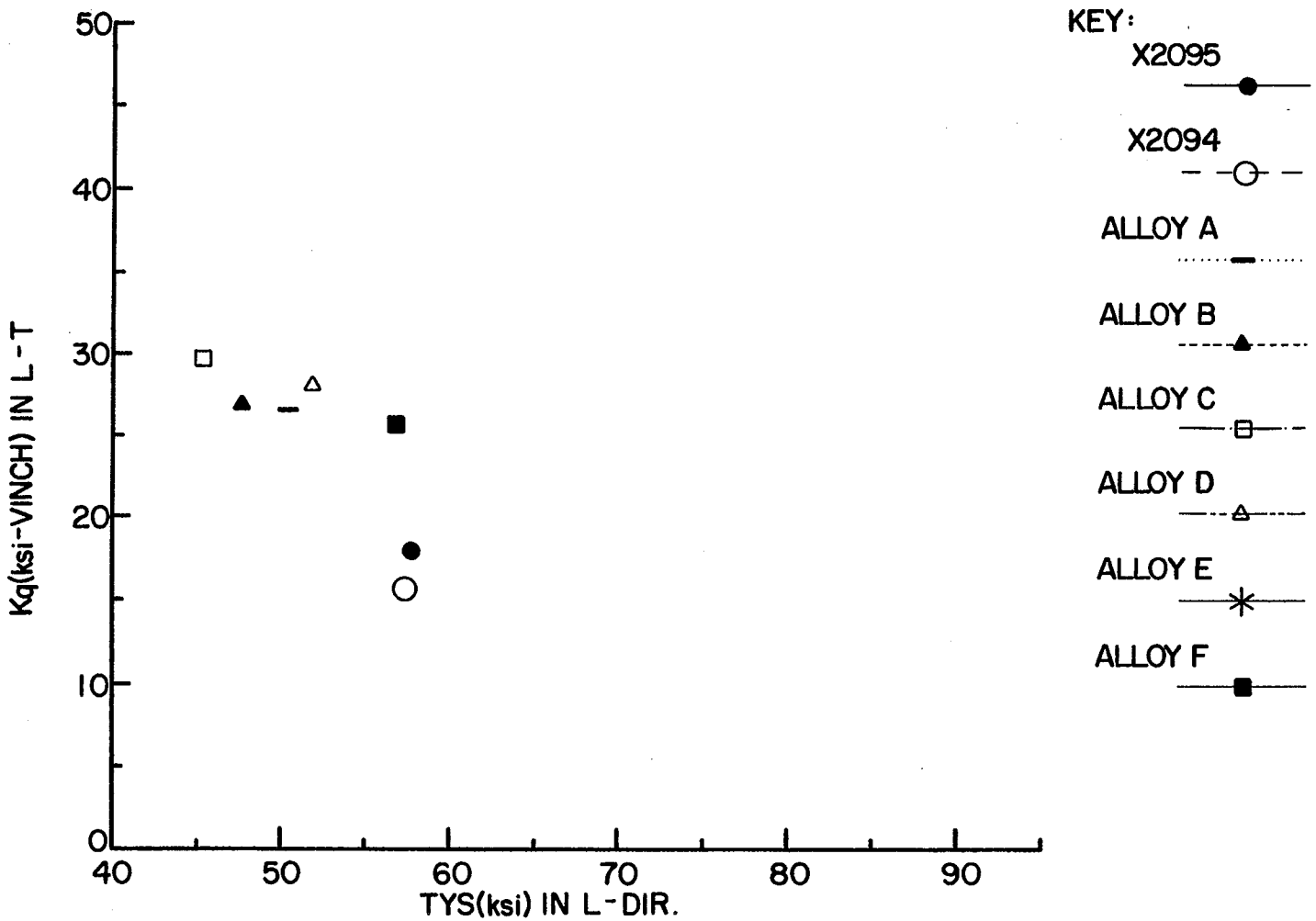
FIG. 6 shows a graph relating fracture toughness and yield strength for the alloy compositions depicted in the key after exposure at 350° F. for about 1,000 hours.

In a manner similar to FIG. 3, the results of aging and the relationship between fracture toughness and tensile yield stress listed in Table IV are shown in FIG. 6. Again, alloy F is superior to the other alloys depicted in this combination of strength and fracture toughness. In this "accelerated testing" at 350° F. for 1000 hours, it is demonstrated that alloy F essentially maintains the same level of fracture toughness as the other low and medium solute alloys while at the same time retaining essentially the same level of strength as the much higher-solute alloys such as AAX2094 and AAX2095.

Based on the results depicted in FIGS. 3–6 and Tables II–IV, it was found that the loss of fracture toughness during overaging and ability to recover fracture toughness after softening by overage are strongly related to the level of combined copper and lithium solute content. As evident from the comparison between alloys A–F, a higher copper content helps to minimize the loss of strength after long term exposure at elevated temperatures.

Based on the thermal exposure test for 100 hours and 1000 hours at 325° F. and 1000 hours at 350° F., alloy F displayed the most preferred characteristics of a minimum loss of strength without losing fracture toughness after long term exposure to elevated temperatures. As demonstrated in FIGS. 3–6, alloy F did not exhibit the undesirable effect of a decrease in fracture toughness below minimal acceptable levels followed by recovery to acceptable levels. In contrast, alloy F maintained an acceptable level of fracture toughness throughout the entire exposure at elevated temperatures. Moreover, the density of alloy F is 6% lighter, i.e., 0.097 lbs/in$^3$ compared to prior art Al-Cu based high strength elevated temperature alloy AA2519. In an effort to further demonstrate the unexpected properties of the inventive alloy composition, Table V compares density and tensile yield stress after 100 hours exposures at 325° F. and 350° F. for alloy F compared to three prior art alloys. As is evident from Table V, alloy F exhibits the lowest density while providing the highest tensile yield stress at both temperature levels.

TABLE V

| Alloy | Density (lbs./in$^3$) | Tensile Yield Stress 325° F. (ksi) | Tensile Yield Stress 350° F. (ksi) |
|---|---|---|---|
| F | .097 | 71 | 64 |
| 2618-T651 | .100 | 50 | 45 |
| 2024-T81 | .101 | 57 | 49 |
| 2519-T87 | .103 | 65 | 59 |

Table VI shows a comparison similar to Table V for alloy F and three prior art alloys. In Table VI, room temperature tensile yield stress after 1000 hours exposure at 325° F. and 350° F. and density are compared. Again, alloy F exhibits the lowest density and highest room temperature tensile yield stress. It should be noted that the properties of 2618, 2024, 2219 and 2519 are taken from "Aluminum-based Materials for High Speed Aircraft" by L. Angers, presented at that NASA Langley Metallic Materials Workshop, Dec. 6–7, 1991.

TABLE VI

| Alloy | Density (lbs./in$^3$) | Room Temp. Tensile Yield Stress After 1,000 hrs Exposure At: 325° F. (ksi) | 350° F. (ksi) |
|---|---|---|---|
| F | .097 | 74 | 57 |
| 2618-T651 | .100 | 51 | 50 |
| 2024-T81 | .101 | 45 | 35 |
| 2219-T87 | .103 | 36 | 35 |

The inventive alloy composition unexpectedly provides a combination of acceptable levels of fracture toughness throughout elevated temperature exposure with high levels of strength. Thus, the inventive alloy composition is especially adapted for use in aerospace and aircraft application which require good thermal stability. In these types of application, fuselage skin material subjected to Mach 2.0 and Mach 2.2 may be exposed to 325° F. Based on the results hereinabove, the inventive alloy composition provides a low density, high strength, aluminum-lithium alloy without serious degradation of fracture toughness during these elevated temperatures while maintaining plane strain fracture toughness values at approximately 20 ksi-$\sqrt{\text{inch}}$ or higher.

It should be noted that although the inventive method has been described in terms of producing plate structure, any structural component may be fabricated using the inventive alloy composition and method. For example, fuselage skin material or structural frame components may be fabricated according to the inventive method and made from the inventive alloy composition.

As such, an invention has been disclosed in terms of preferred embodiments thereof which fulfill each and every one of the objects of the present invention as set forth hereinabove and provides a new and improved aluminum-based alloy composition having both high strength and acceptable levels of fracture toughness throughout exposure to elevated temperatures.

Of course, various changes, modifications and alterations from the teachings of the present invention may be contemplated by those skilled in the art without departing from the intended spirit and scope thereof. Accordingly, it is intended that the present invention only be limited by the terms of the appended claims.

I claim:

1. A method for producing an aluminum alloy product having high fracture toughness and strength at elevated temperatures which comprises the following steps:

a) casting an alloy of the following composition as an ingot or billet:

$$Cu_aLi_bMg_cAg_dZr_eAl_{bal}$$

wherein a, b, c, d, e and bal indicate the amount of each alloying component in weight percent and wherein $2.8<a<3.8$, $0.80<b<1.30$, $0.20<c<1.00$, $0.20<d<1.00$ and $0.08<e<0.40$, and the alloy has a density ranging from 0.095 to 0.0981 lbs/in$^3$;

b) relieving stress in said ingot or billet by heating;

c) homogenizing said ingot or billet by heating, soaking at an elevated temperature and cooling;

d) rolling said ingot or billet to a final gauge product;

e) solution heat treating said product by soaking and then quenching;

f) stretching the product to 5 to 11%; and g) aging said product by heating, said alloy having a Cu:Li ratio falling within an area on a graph having Cu content on one axis and Li content on the other axis, the area being defined by the following corners: (a) 3.8% Cu-0.8% Li; (b) 2.8% Cu-0.8% Li; (c) 2.8% Cu-1.3% Li, (d) 3.45% Cu-1.3% Li and (e) 3.8% Cu-1.07% Li.

2. The method of claim 1 further comprising the step of determining amounts of copper and lithium according to the following formula:

$$Cu(wt\ \%)+1.5Li\ (wt\ \%)<5.4$$

wherein said product maintains an acceptable level of fracture toughness during elevated temperature use of said product.

3. The method of claim 1 comprising the steps of:

a) stress relieving for about 8 hours between about 600° F. and 800° F.;

b) homogenizing said ingot first at about 940° F. for about 8 hours and second at about 1000° F. for about 36 hours, followed by fan cooling;

c) preheating said ingot at 950° F. for about 3–5 hours, air cooling to about 900° F. and hot rolling;

d) solution heat treating at about 1000° F. for about one hour and cold water quenching;

e) stretching to about 6%; and f) aging at about 320° F. to 340° F. for about 12 to 32 hours.

4. A product produced by the method of claim 1 wherein said product exhibits fracture toughness exceeding 20 ksi $\sqrt{\text{inch}}$ when subjected to elevated temperatures of at least about 325° F. for an extended period of time.

5. A product produced by the method of claim 3 wherein said product exhibits fracture toughness exceeding 20 ksi $\sqrt{\text{inch}}$ when subjected to elevated temperatures of at least about 325° F. for an extended period of time.

6. The product of claim 4 wherein said product is an aircraft or aerospace structural component.

7. The product of claim 5 wherein said product is an aircraft or aerospace structural component.

8. A low density aluminum based alloy consisting essentially of the formula $$Cu_aLi_bMg_cAg_dZr_eAl_{bal}$$

wherein a, b, c, d, e and bal indicate the amount of each alloying component in weight percent and wherein $2.8<a<3.8$, $0.80<b<1.3$, $0.20<c<1.000$, $0.20<d<1.00$ and $0.08<e<0.25$, the alloy has a density ranging from 0.095 to 0.0980 lbs/in$^3$ said alloy having high strength and fracture toughness during exposure to elevated temperatures, said alloy having a Cu:Li ratio falling within an area on a graph having Cu content on one axis and Li content on the other axis, the area being defined by the following corners: (a) 3.8% Cu-0.8% Li; (b) 2.8% Cu-0.8% Li; (c) 2.8% Cu-1.3% Li, (d) 3.45% Cu-1.3% Li and (e) 3.8% Cu-1.07% Li.

9. The aluminum based alloy of claim 8, wherein the alloy also contains up to a total of 0.5 wt % of impurities and additional grain refining elements but no single element is present in an amount greater than 0.25 weight %.

10. The aluminum based alloy of claim 8 which has a density of about 0.097 lbs/in.$^3$.

11. The aluminum based alloy of claim 8 wherein copper and lithium amounts are determined by Cu (wt %)+1.5 Li (wt %)<5.4.

12. The aluminum based alloy of claim 8 wherein combined content of copper and lithium is below the solubility limit of copper and lithium in aluminum by at least 0.4 wt % of copper for a given amount of lithium.

13. An aerospace airframe structure produced from an aluminum alloy of claim 8.

14. An aerospace airframe structure produced from an aluminum alloy of claim 11.

15. An aircraft airframe structure produced from an aluminum alloy of claim 12.

* * * * *